United States Patent [19]

Iwanami et al.

[11] 4,365,486

[45] Dec. 28, 1982

[54] WATER-COOLED HEAT-ACCUMULATING TYPE DRINK COOLING SYSTEM

[75] Inventors: Masao Iwanami, Suzuka; Yusuke Ogawa, Yokkaichi, both of Japan

[73] Assignee: Fuji Electric Co., Ltd., Japan

[21] Appl. No.: 278,857

[22] Filed: Jun. 29, 1981

[51] Int. Cl.[3] ..... B67D 5/62

[52] U.S. Cl. ..... 62/392

[58] Field of Search ..... 62/389, 392, 394

[56] References Cited

U.S. PATENT DOCUMENTS

| | | | |
|---|---|---|---|
| 2,657,554 | 11/1953 | Hull | 62/392 |
| 2,978,878 | 4/1961 | Curtis et al. | 62/392 X |
| 2,986,895 | 6/1961 | Moline, Sr. | 62/392 X |
| 3,400,551 | 9/1968 | Booth et al. | 62/392 X |

*Primary Examiner*—Lloyd L. King

*Attorney, Agent, or Firm*—Brumbaugh, Graves, Donohue & Raymond

[57] ABSTRACT

A system for controlling the temperature of the drink cooling coil of a drink cooling system is disclosed. The system is a water-cooled heat-accumulating type drink cooling system having a water tank filled with water, a cooler in said tank, a drink cooling coil formed in an intermediate portion of a drink supply pipeline and an electric water agitator. The cooler is operated to cool the water in the tank by forming an ice bank around the cooler to accumulate heat in the tank, in order to cool a drink in the cooling coil. An agitator stopping means is provided which senses the temperature of the water in the tank and stops the agitator when said temperature is about 0° C., so that an over-cooling of water in the tank occurs generally only at the cooler, and not at the cooling coil, thereby preventing ice from forming inside the cooling coil.

7 Claims, 10 Drawing Figures

WATER-COOLED HEAT-ACCUMULATING TYPE DRINK COOLING SYSTEM

BACKGROUND OF THE INVENTION

1. Technical Field

This invention relates to a water-cooled heat-accumulating type drink cooling system for use in cup-type automatic vending machines for refreshing drinks and dispensers for cold water or refreshing drinks.

2. Description of the Prior Art

In water-cooled heat-accumulating type drink cooling systems, a cooling water tank is filled with water and a cooler is submerged in the water tank which consists of an evaporator for a refrigerator, a drink cooling coil formed at an intermediate portion of a drink supply pipeline, and an electric water agitator. The water in the tank is cooled by the refrigerator and stirred by the agitator, and serves as a heat transfer medium for a drink flowing in the drink cooling coil. In order to minimize the cooling capacity requirements of the refrigerator, an ice layer, also referred to as an ice bank, is always maintained aound the cooler disposed in the water tank. Accordingly, even when the operation of the refrigerator is interrupted, the cooling water in tank can be maintained at a low temperature due to the heat being absorbed by the ice bank. The above described method of momentarily increasing the drink cooling capacity is widely utilized. However, this conventional method has significant disadvantages, as will be described.

When a drink supply instruction is given in this conventional drink cooling system operated in accordance with the above-described method, oftentimes the drink or beverage in the drink supply pipeline becomes clogged in the line even though the pump and supply valve are operating normally. It has been found that this clogging of the drink flow is caused by small pieces of ice forming and gathering in narrow portions of the drink supply pipe-line and inner portions of the supply valve. It has been further determined that the cause of small pieces of ice forming and gathering is apparently because the drink in the drink cooling coil is over-cooled and partly frozen. The reason for the clogging will become more apparent with a more detailed description of the operation of the prior art circuit, which follows.

During an initial stage of the formation of the ice bank on the surface of the cooler, the water in the tank is first over-cooled to a negative temperature of $T_o$°C., which is lower than 0° C., i.e. the freezing point of water. In order for ice to be formed on the surface of the cooler, it is generally necessary that the water around the surface of the cooler be initially over-cooled to a temperature below 0° C. However, soonafter the temperature of the water has been decreased to below 0° C., ice begins to form and the temperature of the water becomes 0° C. Once an initial layer of ice is formed on the surface of the cooler, the ice layer grows continuously in the outward directon. Consequently, due to the continuous operation of the cooler, only the temperature of the surface of the cooler, which is covered with a layer of ice, is maintained at a low level, and over-cooling does not occur in that part of the water in the tank which is not immediately proximate to the surface of the cooler.

When an agitator is continuously operated to stir the water in the tank, the temperature of the water is virtually equal in all parts of the tank, which temperature is substantially equal to that of the cooler. As a result, during the period when ice is being initially formed, an over-cooling phenomenon occurs not only in the water immediately around the cooler but also in the water in the remaining portion of the interior of the tank not immediately proximate to the cooler surface. This over-cooling temperature $T_o$° C. is approximately −0.5° C. to −2.0° C., although it varies depending upon the construction of the water tank, the capacity of the refrigerator and the operational condition of the agitator. Accordingly, when an over-cooling phenomenon occurs without a drink supply instruction given, the drink in the cooling coil is also over-cooled to a temperature below the freezing point, i.e., 0° C., even though the cooling coil is not immediately proximate to the cooler. As a result, small pieces of ice in the pipeline will collect in narrow portions thereof and particularly in an inner portion of the supply valve. The end result is that the flow of drinking water is either blocked, or at the least, the drinking water is not supplied normally.

Since the quantity of drink in an automatic vending machine is normally controlled by controlling the time that the supply valve is opened, a clogging of ice as described above would result in an improper quantity of dispensed drink, which of course would be undesirable. While in the above description the particular fluid being cooled and supplied is drinking water, it should be understood that when syrup or other kinds of drinks are cooled and supplied, a similar over-cooling problem would also likely occur.

SUMMARY OF THE INVENTION

The present invention is directed to preventing a drink in the cooling coil in the above-described drink cooling system from being over-cooled during the formation of an ice bank, and thereby preventing small pieces of ice from being formed in the cooling coil.

The present invention provides the drink cooling system described above with an agitator stopping means adapted to sense a decrease in the temperature of the water in the tank to a level in the neighborhood of its freezing point during a step of cooling the water for the purpose of forming a layer of ice on the surface of the cooler by operating the cooler and agitator, and immediately stop the agitator which has been in operation. The agitator stopping means preferably comprises a thermostat which has a control contact inserted in a drive motor circuit for the agitator and which is adapted to open the contact and stop the agitator when the temperature of the water in the tank has been decreased to a level higher than and in the neighborhood of its freezing point.

Embodiments of the present invention will be described with reference to the accompanying drawings.

DETAILED DESCRIPTION OF THE PREFERRED EMBODIMENTS

Figure 1:
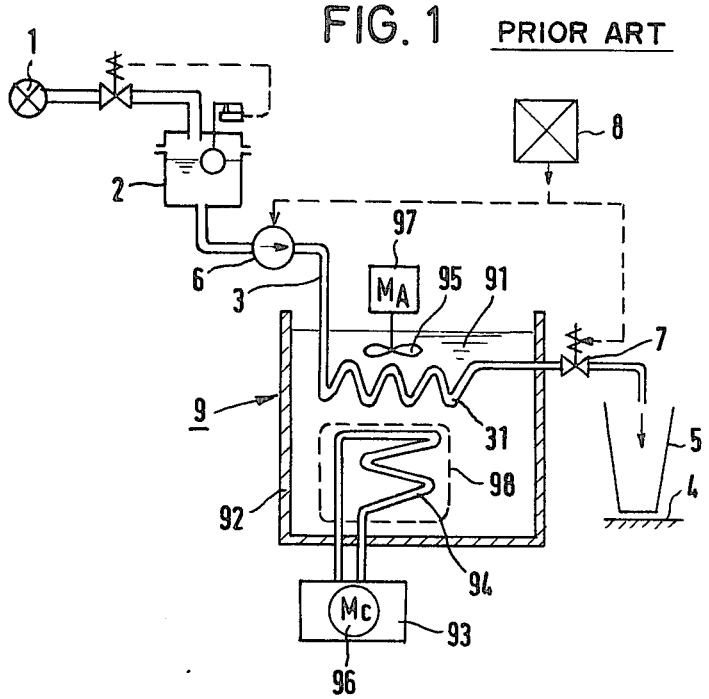
FIG. 1 PRIOR ART
FIG. 1 is a schematic diagram of a conventional water-cooled heat-accumulating drink cooling system.

FIG. 1 is a schematic diagram of a conventional water-cooled heat-accumulating type drink cooling system to which the invention is directed. Referring to FIG. 1, reference numeral 1 denotes a drinking water source, such as city water, reference numeral 2 a drinking water reservoir, and numeral 3 a drinking water supply pipeline extended from the reservoir 2. A vending stage 4 holds a cup 5 placed thereon and receives water when drinking water feed pump 6 pumps drinking water when supply valve 7, provided at that portion of the pipeline 3 which is close to the discharge end thereof, is opened. A drinking water supply control circuit 8 controls pump 6 and valve 7. A drinking water cooling unit 9 is filled with water 91 and consists of a cooling water tank 92, a refrigerator 93, a cooler 94 in the form of an evaporator disposed in the water in the tank, a water agitator 95, and a drinking water-cooling coil 31 formed in an intermediate portion of the pipeline 3 and submerged in the waer 91 in the tank 92 in such a manner that the coil 31 is spaced from the cooler 94. Reference numeral 96 denotes a compressor motor for the refrigerator 93, numeral 97 a drive motor for the agitator 95, and numeral 98 an ice bank formed around the cooler 94.

Drinking water is stored in the reservoir 2 at all times. When a drinking water supply signal is given, the supply valve 7 is opened, and the pump 6 is operated at the same time to allow the drinking water cooled in the cooling coil 31 to be fed into the cup 5.

Figure 2:
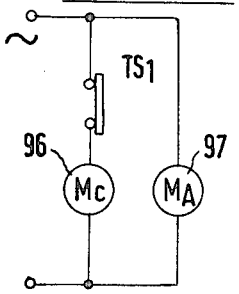
FIG. 2 PRIOR ART
FIG. 2 is a diagram of a conventional operation control circuit for the drink cooling system of FIG. 1.

A conventional operation control circuit for the refrigerator compressor motor 96 and the agitator drive motor 97 in a drink cooling system is shown in FIG. 2. Reference symbol $TS_1$ denotes a contact of a compressor control thermostat connected in series with the compressor motor 96. A temperature-sensitive portion of the contact $TS_1$ is provided and is spaced from the cooler 94. When a layer of ice formed around the cooler has grown into an ice bank 98 of a predetermined thickness, the temperature-sensitive portion of the contact $TS_1$ is covered therewith, so that the temperature of the ice is sensed by the temperature-sensitive portion of the contact $TS_1$. As a result, the control contact opens to cause the compressor motor 96 to be stopped. When the ice bank 98 becomes melted so that the thickness thereof decreases to a predetermined amount, the control contact is closed and the compressed motor 96 is actuated again, so that the operation of the refrigerator 93 is resumed. An electrode type ice sensor may be substituted for the above-mentioned thermostat used as an operation control means for the compressor motor. In the meantime, the drive motor 97 for the agitator is operated continuously while the drink cooling system is in operation, for the purpose of improving a total heat transfer coefficient. Accordingly, the water 91 in the tank 92 continues to be agitated in the conventional system.

Figure 3:
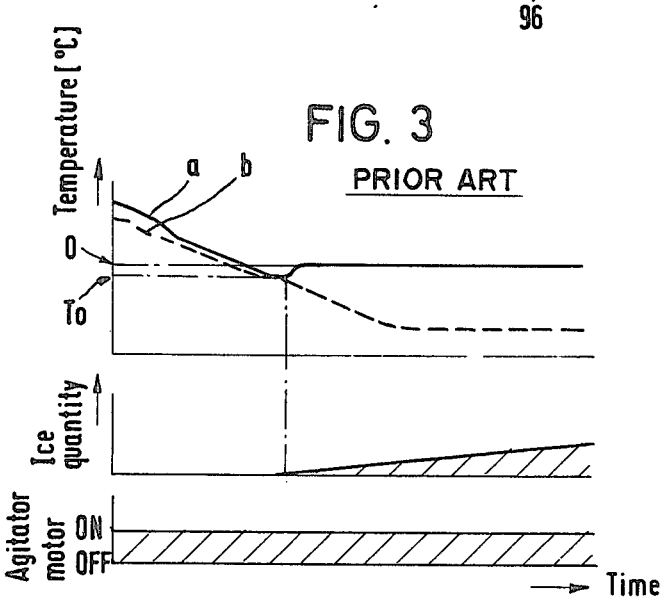
FIG. 3 PRIOR ART
FIG. 3 is a time chart of a cooling operation conducted by the conventional operation control circuit shown in FIG. 2.

FIG. 3 is a time chart for the operation of the drink cooling system having the conventional circuit shown in FIG. 2. The temperature characteristic curves a and b in the drawing represent the temperature of the water in the tank 92 and the temperature of the surface of the cooler 94, respectively. The ice layer thickness as a function of time is also shown, along with the state of the agitator motor, which is shown as being continuously operating. As described above in the section entitled "Description of the Prior Art", this prior art arrangement results in an over-cooling condition of the cooling coil, which results in small pieces of ice being formed inside the cooling coil 31. When a drink supply instruction is given, pump 6 is actuated and valve 7 opens, resulting in ice being collected and clogging the narrow portions of the pipeline 3 and valve 7, which of course is undesirable.

Figure 4:
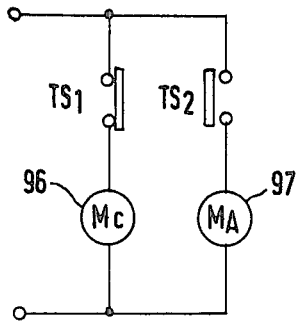
FIG. 4 is a diagram of an operation control circuit in a first embodiment of the present invention.
Figure 5:
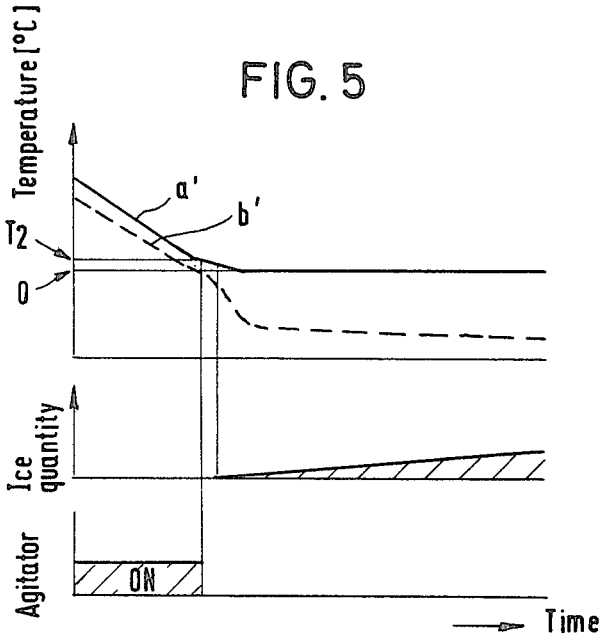
FIG. 5 is a time chart of a cooling operation conducted by the operation control circuit shown in FIG. 4.

FIG. 4 shows one embodiment of an operation control circuit of the present invention. In this operation control circuit, as comared with the operation control circuit shown in FIG. 2, a contact $TS_2$ of an agitator stopping thermostat is inserted in the power source circuit for the agitator drive motor 97. A temperatue-sensitive portion of the contact $TS_2$ for the thermostat is provided sufficiently spaced from the cooler 94. The thermostat is adapted to sense a decrease in the temperatue of the water in the tank 91 to a positive level $T_2$, which is in the neighborhood of its freezing point of 0° C., during a step of cooling the water by operating the cooler as shown in a time chart of operation shown in FIG. 5, and open the contact $TS_2$.

When the temperature of the water 91 in the tank 92 in the drink cooling system provided with the above-described agitator stopping means has been decreased to a level $T_2$° C., in the neighborhood of 0° C., during a step of cooling the water 91 by operating the cooler 94 with the agitator also in operation (for the purpose of forming an ice bank 98 on the surface of the cooler), the temperature $T_2$° C. is sensed by the temperature-sensitive portion $S(TS_2)$ of the contact $TS_2$ of the thermostat. As a result, the contact $TS_2$ is opened and the drive motor 97 for the agitator is stopped. When the motor 97 is stopped, the water 91 stops being agitated, and becomes calm. Consequently, an over-cooling phenomenon occurs only in a limited portion of the water 91, i.e. that portion of the water 91 which is close to the cooler 94. Therefore, an over-cooling phenomenon does not extend to the circumferential area of the drink cooling coil 31, which is disposed in a position away from the cooler 94, and small pieces of ice do not form in the drinking water in the cooling coil. The temperature characteristics of the water in this tank is shown as curve a' in FIG. 5.

Another embodiment of the present invention constructed on the basis of the basic circuit mentioned above will be described.

Figure 6:
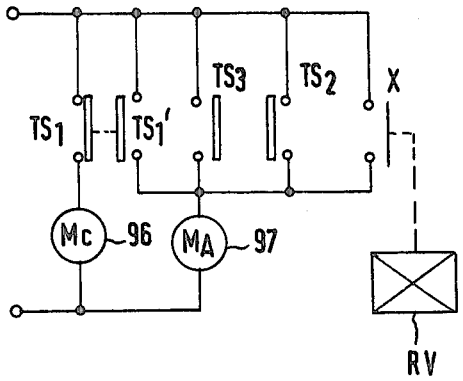
FIG. 6 is a diagram of an operation control circuit in another embodiment of the present invention.

An operation control circuit of this embodiment, which employs a thermostat as an ice formation sensor, is shown in FIG. 6. The circuit shown in FIG. 6 is provided, in addition to the contact $TS_2$ of the basic circuit shown in FIG. 4, with a b contact $TS_1'$ of the above-mentioned compressor motor control thermostat, a control contact $TS_3$ of the agitator re-starting thermostat and a control contact X of a relay RV which is operated in accordance with a drink supply instruction. These four control contacts are connected together in parallel to form an OR-circuit, which is inserted in an agitator motor circuit.

Temperature sensitive portions $S(TS_1)$, $S(TS_2)$, $S(TS_3)$ of the contacts $TS_1$, $TS_2$, $TS_3$ of the above-mentioned thermostats are aligned with one another with respect to the cooler 94.

Figure 7:
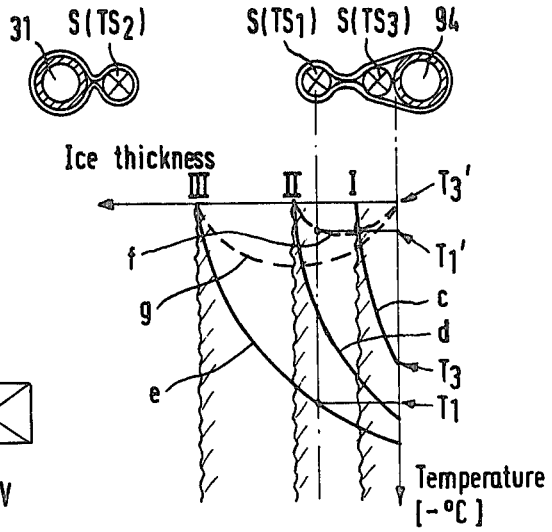
FIG. 7 illustrates the arrangement and principle of operation of the thermostats used in the operation control circuit shown in FIG. 6.

In FIG. 7, in which the axis of the abscissas is taken in the direction of the thickness of ice, and in which the axis of the ordinates is taken in the direction of negative temperature, the characteristic curves, designated by symbols c–g, represent the distributions of temperature of the inner portion of a layer of ice. The solid curves c, d and e represent the distributions of temperature in the inner portion of a layer of ice with respect to its thicknesses I, II and III, respectively, formed around the cooler 94 with the refrigerator in operation. The broken curves f and g represent the distributions of temperature of the inner portion of the layer of ice with respect to its thicknesses II, III formed around the cooler 94 with the refrigerator not in operation.

When a layer of ice of a small thickness is formed on the surface of the cooler 94 in a step of cooling the water in the tank 92 to form an ice bank, the temperature of the surface of the cooler 94 is rapidly decreased to a negative temperature $T_3$, which is sensed by the temperature sensitive portion $S(TS_3)$, which is in contact with the surface of the cooler 94, of the contact $TS_3$ of the agitator restarting thermostat. As a result, the control contact is closed to allow the agitator 95, the operation of which had previously been stopped by the contact TS, to be started again. Since an over-cooling phenomenon does not occur in the tank 92 for the reasons previously given, after a layer of ice has once formed around the cooler 94, the heat exchange efficiency of the cooling water and drink cooling coil, i.e. the drink cooling capacity of the drink cooling system, can be increased by re-starting the agitator 95 in the mentioned manner. The thermostat contact TS is adapted to be reopened at the temperature $T_3'$ which is substantially equal to 0° C. The difference between the temperatures $T_3$ and $T_3'$ constitutes a differential of the thermostat.

When the layer of ice formed on the surface of the cooler 94 has grown by a continuous operation of the cooler 94, to attain a predetermined thickness III, an ambient temperature of the temperature sensitive portion $S(TS_1)$ of the thermostat contact $TS_1$ is decreased to $T_1$. The thermostat contact $TS_1$ sensing this temperature is actuated to stop the compressor motor 96 and to close the control contact $TS_1'$ of the motor circuit for the agitator (refer to FIG. 6). When the ice is then gradually melted with its thickness decreased to the level II, an ambient temperature $T_1'$ is sensed by the temperature sensitive portion of the thermostat $TS_1$, so that the contact thereof is shifted to allow the compressor motor 96 to be operated again.

In short, the operation of the freezer is controlled by the thermostat contact TS in such a manner that the thickness of ice can be maintained between the levels II and III, unless the drink is supplied continuously to cause great variations in load. When the compressor motor 96 is stopped, the refrigerant ceases to flow in the cooler 94, so that the temperature of the outer surface thereof is increased to substantially 0° C.

The role of the relay contact X will now be described. The relay RV is adapted to receive a drink supply instruction and close its control contact X. When the contact X has thus been closed, the agitator 95 is operated. The operation of the contact X is not restricted by the operational conditions for the other thermostats. In other words, even in the case where the temperature of the cooling water had decreased to a level in the neighborhood of 0° C. during the formation of ice and had caused the agitator to be stopped by the agitator stopping thermostat contact $TS_2$, when a drink supply instruction is given, the agitator is operated immediately in preference to the operation of the thermostat contact $TS_2$. Also, even when an over-cooling phenomenon occurs in the whole of the interior of the water tank by the operation of the agitator, small pieces of ice are not formed in the drink cooling coil 31 as long as a drink flows in the drink supply pipeline 3. The operation of the agitator 95 even serves to improve the effect of heat exchange between the drink cooling coil 31 and cooling water to allow the drink to be cooled in an excellent manner.

Figure 10:
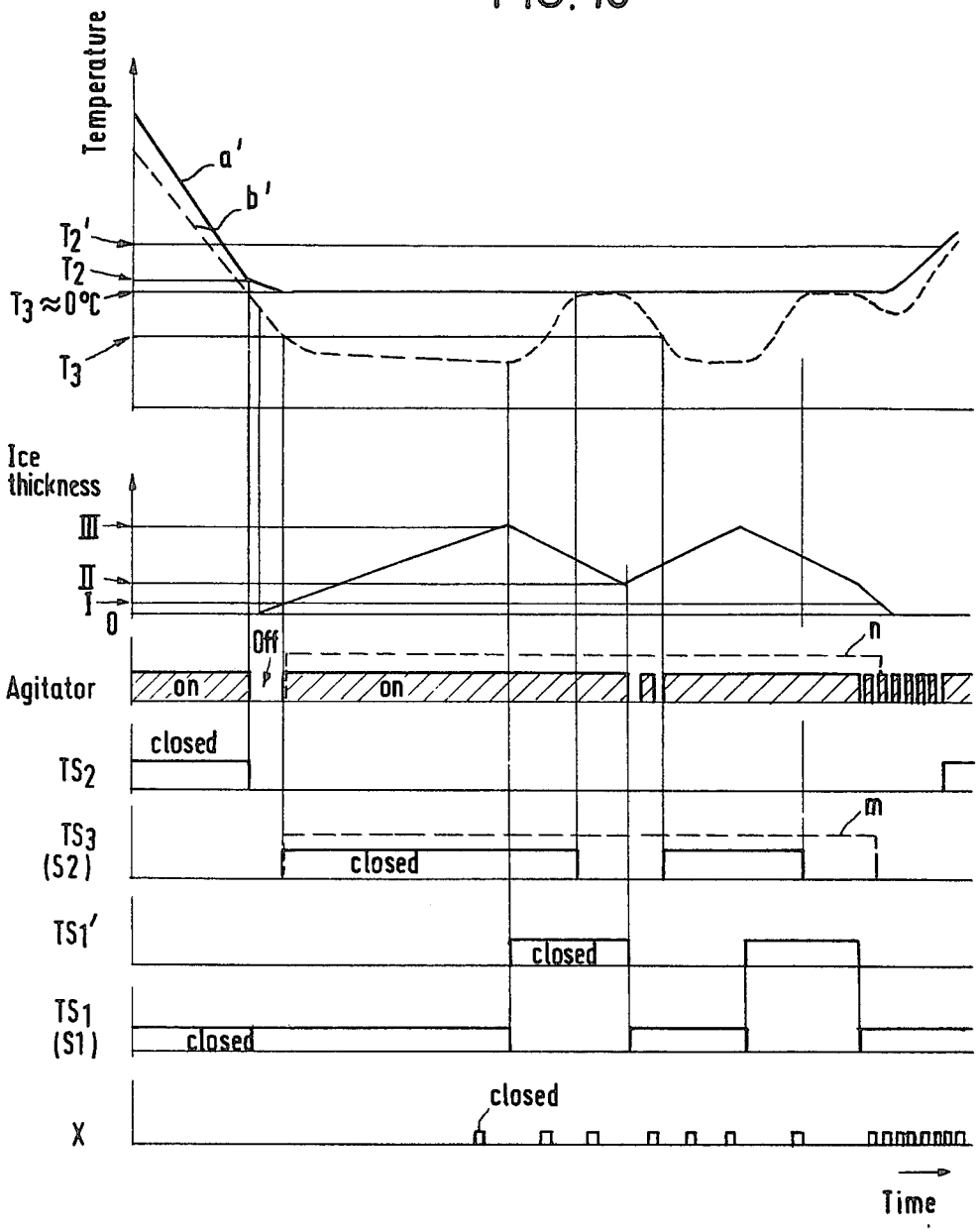
FIG. 10 is a time chart of cooling operations conducted by the operation control circuits shown in FIGS. 6 and 8.

FIG. 10 is a time chart of an operation of the operational control circuit shown in FIG. 6, which chart has been prepared on the basis of the operation described above.

As is clear from FIG. 10, when the temperture of the cooling water has been decreased to a level in the neighborhood of 0° C. in an initial stage of formation of a layer of ice on the surface of the cooler, the operation of the agitator is stopped to prevent that portion of the water in the tank which is around the drink cooling coil from being over-cooled. Consequently, the drinking water is not over-cooled as may be noted from the temperature characteristic curve a' of the cooling water, and small pieces of ice are prevented from being formed in the drink cooling coil. Since the water in the tank is stirred by the agitator to such an extent that an over-cooling phenomenon does not occur in the entire interior region of the tank, and in a drink supply period during which the drinking water flows in the drink cooling coil, a high total heat transfer coefficient can be obtained, and also a high drink cooling capacity can be maintained.

Another embodiment of the present invention employing an electrode type ice sensor as an ice formation detecting means will be described with reference to FIGS. 8 and 9.

Figure 8:
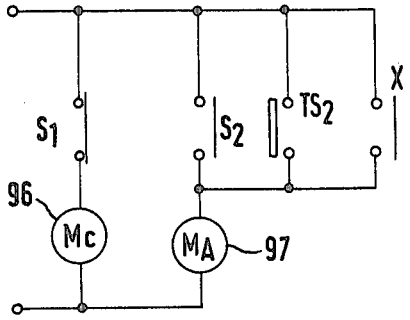
FIG. 8 is a diagram of an operation control circuit in still embodiment of the present invention.
Figure 9:
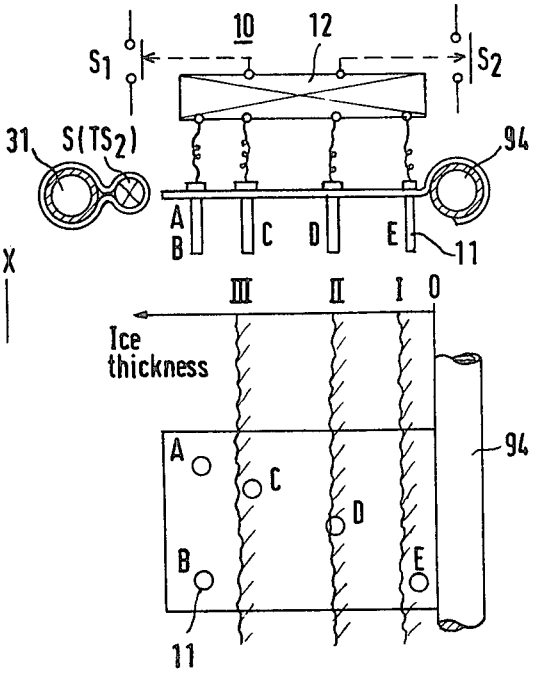
FIG. 9 illustrates the construction and principle of operation of an electrode type sensor used in the operation control circuit shown in FIG. 8.

Control contacts $S_1$ and $S_2$ shown in FIG. 8 perform the same roles as the control contacts designated by symbols $TS_1$, $TS_3$ in FIG. 6. The control contacts $S_1$, $S_2$ are opened and closed by an output signal from an electrode type ice sensor 10. The ice sensor 10 consists of five electrodes designated by symbols A–E and arranged on one side of the cooler 94 in such a manner as shown in FIG. 9, and a detector circuit 12. The electrodes A and B are reference electrodes constantly positioned in the water in the tank, and the electrodes, C, D and E are ice sensor electrodes disposed in positions corresponding to ice thicknesses III, II and I, respectively, of ice to be formed. The detector circuit 12 consists of, for example, a bridge circuit for use in comparing the resistance between the electrodes A–B and the resistances between the electrodes A–C, A–D and A–E. The detector circuit 12 is adapted to output a signal on the basis of the difference between the resistances measured and compared in the above-mentioned manner.

The operation of the ice sensor 10 will be described in detail.

As is generally known, the specific resistance of water and that of ice differ from each other by a two-digit number. Accordingly, when no ice is formed on the surface of the cooler 94, the spaces between the electrodes A–B, A–E are occupied by water. In such a case, the resistances are in a balanced state, so that no signal is outputted from the circuit 12. On the other hand, when ice is formed to cover the electrode E therewith, the balance between the resistances between the electrodes A–B, A–E is lost, and the formation of ice sensed by the ice sensor causes a signal to be outputted therefrom which closes control contact $S_1$. Also, while the resistances between the electrodes A–B, A–C are in a balanced state, the control contact S is closed, and the compressor motor 96 continues to be operated. When the layer of ice has grown to attain a thickness III and causes the balance of resistance to be lost, the control contact $S_1$ is opened, and the compressor motor 96 is stopped.

When the ice is then melted so that the thickness thereof decreases to the thickness II, the electrode D is exposed to water, with the result that the resistance 5 between the electrodes A–B, A–D become balanced. As a result, the control contact $S_1$ is closed again to allow the operation of the compressor motor 96 to be resumed. The condition of formation of ice on the surface of the cooler 94 is thus sensed by the ice sensor, and the control contacts $S_1$, $S_2$ permit controlling the operations of the compressor motor 96 and agitator motor 97 in a desired manner just as the control contacts $TS_1$, $TS_3$ shown in FIG. 6. A time chart of the operation of the drink cooling system utilizing the above-described control method is substantially identical with that shown in FIG. 10. However, the control contact $S_2$ continues to be closed as shown in broken line in FIG. 10 until the ice has been melted substantially completely, with the agitator kept operated therewith as shown in broken line in the same drawing.

According to the present invention, which may be clearly understood from the above, the operation of the agitator for use in stirring the water in the tank is stopped when the temperature of the water is in the neighborhood of 0° C. in an initial stage of formation of a layer of ice around the cooler of the refrigerator. Consequently, an over-cooling phenomenon occurs only in an extremely limited, small space proximate to the cooler, and that portion of the water in the tank which is not proximate to the drink cooling coil is not over-cooled to a temperature below 0° C. As a result, small ice pieces are not formed in the drink cooling coil. Therefore, the drink cooling system according to the present invention remains free from the clogging of ice in the drink supply line 31 which is otherwise encountered in a conventional drink cooling system of this kind, and permits supplying a drink smoothly.

Although the invention has been described and illustrated with respect to specific embodiments thereof, many modifications and variations of such embodiments may be made by one skilled in the art without departing from the inventive concepts disclosed. Accordingly, all such modifications and variations are intended to be within the spirit and scope of the appended claims.

We claim:

1. In a water-cooled heat-accumulating type drink cooling system having a water tank filled with water and a cooler disposed therein, a drink cooling coil formed at an intermediate portion of a drink supply pipeline, and an electric water agitator, said cooler being operated to cool the water in said tank to form an ice bank around the cooler and accumulate heat in the ice bank, a drink flowing through said drink cooling coil being cooled with the cooling water in said tank, the improvement therein comprising:

an agitator stopping means for sensing, while said cooler is operated to cool the water in said tank and form an ice bank around the cooler, a decrease in the temperature of the water in said tank to a level higher than and in the neighborhood of its freezing point, and for stopping said agitator in response thereto.

2. A water-cooled heat-accumulating type drink cooling system according to claim 1, wherein said drink cooling system further includes:

an agitator re-starting means for sensing the formation of an ice bank and for re-starting said agitator when said agitator is stopped.

3. A water-cooled heat-accumulating type drink cooling system according to claim 1, wherein said drink cooling system further includes:

an agitator control means for operating said agitator in response to a drink supplying instruction independently of the operation of said agitator stopping means.

4. A water-cooled heat-accumulating type drink cooling system according to clim 1, wherein said agitator stopping means comprises:

a thermostat having a temperature sensing portion capable of sensing the temperature of the water in said tank, and a control contact provided in a drive motor circuit for said agitator, said thermostat opening said control contact when the temperature of the water in said tank decreases to a level higher than and in the neighborhood of 0° C.

5. A water-cooled heat-accumulating type drink cooling system according to claim 2, wherein said agitator re-starting means comprises:

a thermostat having a temperature sensing portion capable of sensing the temperature of a surface of said cooler, and a control contact provided in a drive motor circuit for said agitator, said thermostat closing said control contact when the temperature of a surface of said cooler decreases to a level indicating the formation of an ice bank around the cooler.

6. A water-cooled heat-accumulating type drink cooling system according to claim 2, wherein said agitator re-starting means comprises:

an electrode type ice sensor including an electrode located in the vicinity of a surface of said cooler which senses the formation of ice based upon the difference between the electric resistance of water and the electric resistance of ice and outputs a signal when ice is formed in said vicinity, and a control contact provided in a drive motor circuit for said agitator which closes in response to an output signal from said ice sensor.

7. A water-cooled heat-accumulating type drink cooling system according to claim 3, wherein said agitator control means comprises:

a relay which closes a control contact provided in a drive motor circuit for said agitator in response to a drink supplying instruction.

* * * * *